US007301432B1

(12) United States Patent
Smith

(10) Patent No.: US 7,301,432 B1
(45) Date of Patent: Nov. 27, 2007

(54) FUSING TERMINAL DEVICE

(75) Inventor: Thomas J. Smith, Bay Shore, NY (US)

(73) Assignee: TII Network Technologies, Inc., Copiague, NY (US)

( * ) Notice: Subject to any disclaimer, the term of this patent is extended or adjusted under 35 U.S.C. 154(b) by 375 days.

(21) Appl. No.: 11/032,830

(22) Filed: Jan. 11, 2005

(51) Int. Cl.
*H01H 85/02* (2006.01)
*H01H 85/22* (2006.01)

(52) U.S. Cl. ..... 337/186; 337/187; 337/188; 361/104; 361/119; 361/833

(58) Field of Classification Search ..... 337/186–188; 361/104, 119, 833
See application file for complete search history.

(56) References Cited

U.S. PATENT DOCUMENTS 3,976,849 A 8/1976 Champan
4,051,546 A 9/1977 Scheithauer
4,161,762 A 7/1979 Scheithauer
4,346,554 A 8/1982 Glinecke
4,427,964 A 1/1984 Ruegsegger
4,467,148 A 8/1984 Stafford et al.
4,529,971 A 7/1985 James
4,652,848 A 3/1987 Hundrieser
4,661,807 A * 4/1987 Panaro ..... 340/638
4,679,224 A 7/1987 Lynch et al.
4,686,697 A 8/1987 Shapiro et al.
4,706,059 A * 11/1987 Schmitt ..... 337/297
4,709,296 A 11/1987 Hung et al.
4,796,420 A 1/1989 Gueli
4,815,119 A 3/1989 Mills
4,836,802 A * 6/1989 Phillips ..... 439/620.33
4,869,171 A 9/1989 Abouav
4,936,287 A 6/1990 Hart et al.
4,945,555 A 7/1990 Teumer et al.
4,947,427 A 8/1990 Rosch et al.
4,966,561 A * 10/1990 Norden ..... 439/620.34
5,120,152 A 6/1992 Gueli
5,146,384 A 9/1992 Markovic et al.
5,153,988 A 10/1992 Mattis et al.
5,163,079 A 11/1992 Crowdis (Continued)

OTHER PUBLICATIONS

Go Digital Networks, Tech Note 010223, Gel-Filled Protector Use with Go Digital OSP Units, pp. 1-6, Jun. 24, 2003.

(Continued)

*Primary Examiner*—Anatoly Vortman
(74) *Attorney, Agent, or Firm*—Morgan & Finnegan LLP

(57) ABSTRACT

A fusible link device comprising a housing that contains terminals for terminating incoming/outgoing wires, and that also contains a fusible link that interconnects a pair of the terminals in series, the fusible link device providing a self-contained unit/module for terminating and fusing wires to be electrically interconnected in series. The housing includes ports for inserting the wires that terminate on the terminals. These ports may be environmentally protected, such as by gel-sealing. The terminals may be implemented as insulation displacement connectors for connecting the wires and/or the fusible links. In one implementation, the fusible link device may contain a total of four of the terminals and two fusible links for terminating and fusing the tip and ring lines in a telecommunications network. The fusible link device may also include one or more voltage protection devices, of the same or different type, electrically connected across terminals that are not series connected to each other.

20 Claims, 8 Drawing Sheets

U.S. PATENT DOCUMENTS 5,218,616 A 6/1993 Stephens
5,273,449 A 12/1993 Mattis et al.
5,294,906 A 3/1994 Totsuka et al.
5,304,740 A 4/1994 Bozell et al.
5,331,130 A 7/1994 Kirker
5,416,461 A 5/1995 Totsuka et al.
5,418,347 A 5/1995 Kirker
5,457,592 A 10/1995 Smith
5,478,982 A 12/1995 Kirker
5,508,877 A 4/1996 Smith
5,537,471 A 7/1996 Smith
5,553,136 A 9/1996 Meyerhoefer et al.
5,594,403 A * 1/1997 Taga et al. ..... 337/186
5,631,620 A 5/1997 Totsuka et al.
5,670,928 A * 9/1997 Cheng et al. ..... 337/188
5,670,929 A 9/1997 Totsuka
5,687,213 A 11/1997 Larkin
5,724,220 A 3/1998 Chaudhry
5,797,759 A 8/1998 Mattis et al.
5,825,274 A 10/1998 Totsuka
5,841,338 A * 11/1998 Yasukuni ..... 337/293
5,880,665 A * 3/1999 Yetter et al. ..... 337/227
6,046,665 A * 4/2000 Oh et al. ..... 337/191
6,053,780 A 4/2000 Ono et al.
6,129,575 A 10/2000 Daoud
6,147,586 A * 11/2000 Saitoh et al. ..... 337/297
6,152,760 A 11/2000 Reeser
6,205,201 B1 3/2001 Prince
6,233,160 B1 * 5/2001 Shockley ..... 361/833
6,299,475 B1 10/2001 Huspeni et al.
6,315,595 B1 11/2001 LaPorte et al.
6,350,144 B1 2/2002 Afflerbaugh et al.
6,359,227 B1 3/2002 Oh et al.
6,373,259 B1 4/2002 Daoud
6,396,380 B1 * 5/2002 Girke et al. ..... 337/189
6,404,322 B1 6/2002 Ruegsegger et al.
6,577,222 B1 6/2003 Krueger et al.
6,614,880 B1 9/2003 Lysaght et al.
6,650,222 B2 * 11/2003 Darr et al. ..... 337/187
6,729,900 B2 * 5/2004 Dooley ..... 439/417
6,753,754 B1 * 6/2004 Black et al. ..... 337/215
6,967,560 B2 * 11/2005 Andoh et al. ..... 337/198
7,095,628 B2 * 8/2006 Friedrich et al. ..... 361/833
2001/0043139 A1 * 11/2001 Endo et al. ..... 337/238
2004/0100786 A1 * 5/2004 HOng ..... 361/837
2006/0285280 A1 * 12/2006 Shyu ..... 361/628

OTHER PUBLICATIONS

TII Network Technologies, Inc., TII Angle Driver AD-01W, Gel Sealed Station Protector, DataSheet (2 pp.), Mar. 2002.

Corning Cable Systems, IDC Terminal Block Universal IDC Family, an Evolant Solutions Product, Product Specifications (2 pp.), Dec. 2003.

Tyco Electronics, Raychem DataGuard GSSP, Gel Sealed Station Protector, DataSheet (2 pp.), 1999.

* cited by examiner

FUSING TERMINAL DEVICE

FIELD OF THE INVENTION

The present invention relates to a fusible link and, more particularly, to an enclosed fusible link applicable for interconnecting telecommunication wires, such as wires from a telecommunications provider to subscriber drop wiring.

BACKGROUND OF THE INVENTION

UL requirements specify that to protect against power surges in telephone lines and, particularly to provide current limiting, the network must include a fusing link at any network termination, such as the outside plant (OSP) terminations located at splice points (e.g., terminal blocks), building entrances (e.g., building entrance protectors (BEPs)), and/or other premises (e.g., station protectors or network interface devices (NIDs) at homes). More specifically, for example, a network termination point where these fusing links typically have been implemented is at the terminal block that is used for connecting the telco wires of the cable that runs from the telco central office to the wires that run to subscribers' premises.

Commonly, these terminal blocks are located on a telephone pole, in a ground-based pedestal closure, within an underground handhole, or at an in-building application (e.g., on outside wall, or in building service area). For convenience, the telco wires entering the terminal block from the central office side are herein referred to as the exchange wires, distribution wires, or main wires. The wires running from the terminal to the subscriber premises (where they are terminated at an NID or station protector) are commonly referred to as service drop lines, each drop line including one or more pairs of wires (tip-ring wire pair), with each pair servicing one piece of equipment such as a telephone, a fax, or an alternative form of modem.

Fusible links are typically provided at the terminal block as a stub cable comprising individual wire segments connected in series between the terminal block terminals and each wire from the telco distribution wire. Particularly, the fusible link is implemented as the finest gauge wire in the network. Thus, if excessive energy (e.g. voltage surges) appears in the network, the fusing link will fail and the excessive energy will not travel to the telephone lines.

The fusing links provided in this manner at the terminal block are typically contained within a closure containing the terminal block. Although this closure may be implemented to provide protection from environmental damage (e.g., corrosion), terminal block modules typically have been typically implemented to provide additional environmental protection (as well as surge protection) for interconnecting the drop lines to the telco distribution wires. The fusible links, however, are not implemented in a way that provides additional environmental protection. The fusible links (including their connections) are thus susceptible to environmental effects (e.g., corrosion) and/or other damage, wear, shorting, etc. Additionally, the fusible links are not well suited for servicing (e.g., repair or replacement) or testing.

SUMMARY OF THE INVENTION

The present invention overcomes the above mentioned problems and other limitations of the background and prior art by incorporating a fusible link within a module that contains terminals/connectors series connected by the fusible link, and more particularly, by providing a fusible link device comprising a housing that contains terminals for terminating incoming/outgoing wires, and that also contains a fusible link that interconnects a pair of the terminals in series, the fusible link device thus providing a self-contained unit/module for terminating and fusing wires to be electrically interconnected in series.

In accordance with an aspect of the present invention, a fusible link device comprises a housing that encases (i) a plurality of terminals for terminating a respective plurality of wires, and (ii) a plurality of fusible links, each fusible link conductively connected in series between a respective pair of the plurality of terminals. The housing includes ports for inserting the wires that terminate on the terminals. These ports may be environmentally protected, such as by gel-sealing. The terminals may be implemented as insulation displacement connectors for connecting the wires and/or the fusible links. In one implementation, the fusible link device may contain a total of four of the terminals and two fusible links for terminating and fusing the tip and ring lines in a telecommunications network.

In accordance with another aspect of the present invention, the fusible link device may also include one or more voltage protection devices, of the same or different type, electrically connected across terminals that are not series connected to each other. For instance, in an implementation of a fusible link device that contains a total of four terminals and two fusible links for terminating and fusing the tip and ring lines in a telecommunications network, a voltage protection device (e.g., a gas tube protector) may be connected in parallel across the tip and ring lines on one side of the fusible links (e.g., on the telco distribution side or on the service drop side, considering the case where the fusible link device is to be provided at a terminal block or similar point in the OSP). An additional voltage protection device, of the same or different type, may be connected in parallel across the tip and ring lines on the other side of the fusible links. Additional voltage/surge protection may be included on either or both sides of the fusible links.

It will be appreciated by those skilled in the art that the foregoing brief description and the following detailed description are exemplary and explanatory of this invention, but are not intended to be restrictive thereof or limiting of the advantages which can be achieved by this invention. Thus, the accompanying drawings, referred to herein and constituting a part hereof, illustrate preferred embodiments of this invention, and, together with the detailed description, serve to explain the principles of this invention.

BRIEF DESCRIPTION OF THE DRAWINGS

Additional aspects, features, and advantages of the invention, both as to its structure and operation will be understood and will become more readily apparent when the invention is considered in the light of the following description made in conjunction with the accompanying drawings, wherein.

DETAILED DESCRIPTION OF THE INVENTION

Figure 1:
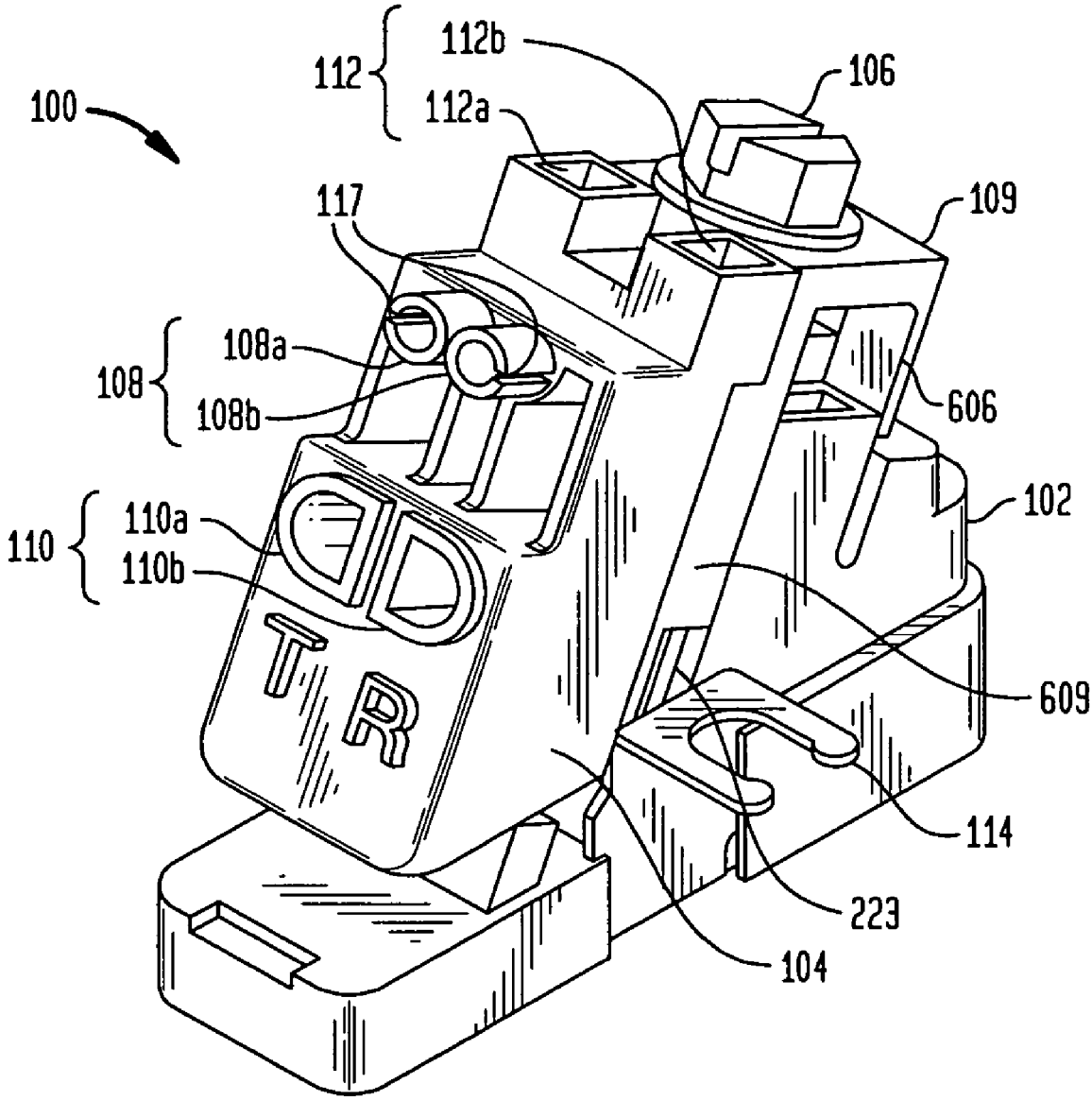
FIG. 1 is a perspective view of a fusible link device according to an embodiment of the present invention.

FIG. 1 depicts an illustrative fusible link device 100 in accordance with an embodiment of the present invention. This illustrative embodiment is implemented as a modification of various versions of TII Angle Driver® station protectors, such as the TII Angle Driver® AD-01W Gel-Sealed Station Protector, made and sold by the assignee of the present invention. More specifically, as will be further understood in view of the ensuing description, fusible link device 100 incorporates various features of the TII Angle Driver® protectors, including, for example, an angle driven housing, gel-sealed IDC (Insulation Displacement Connection) type connectors, gel-sealed test ports, and strain relief ports. Although such general mechanical design features of fusible link device 100 are similar to those of TII Angle Driver® protectors, those skilled in the art will understand in view of the ensuing description that a fusible link device according to the present invention is not limited to incorporating mechanical design features as implemented in the TII Angle Driver® protectors, and may be designed and implemented without being based on the TII Angle Driver® design.

Referring more specifically to FIG. 1, fusible link device 100 includes a housing comprising a base 102 and a cover 104 movably engaged to each other such that driving of a drive screw 106 causes displacement of cover 104 relative to base 102, as further described below. Cover 104 includes a pair of lower ports 110, a pair of upper ports 108, and a pair of test ports 112. Cover 104 may be formed from any of a variety of insulating materials (e.g., plastics, resins, or other plastic materials), and is preferably made from a polycarbonate material, which is transparent, strong, and flame retardant. Base 102 may be formed from any such materials, and in this embodiment, is formed from polyester, which has good heat temperature characteristics. The housing serves as a closure containing (i) two pairs of conductive terminals disposed in the interior thereof for connecting to wires inserted through upper and lower ports 108 and 110, and (ii) a pair of fusible links, each of which connects a respective one of the conductive terminals corresponding to an upper port with a respective one of the conductive terminals corresponding to a lower port.

Figure 2:
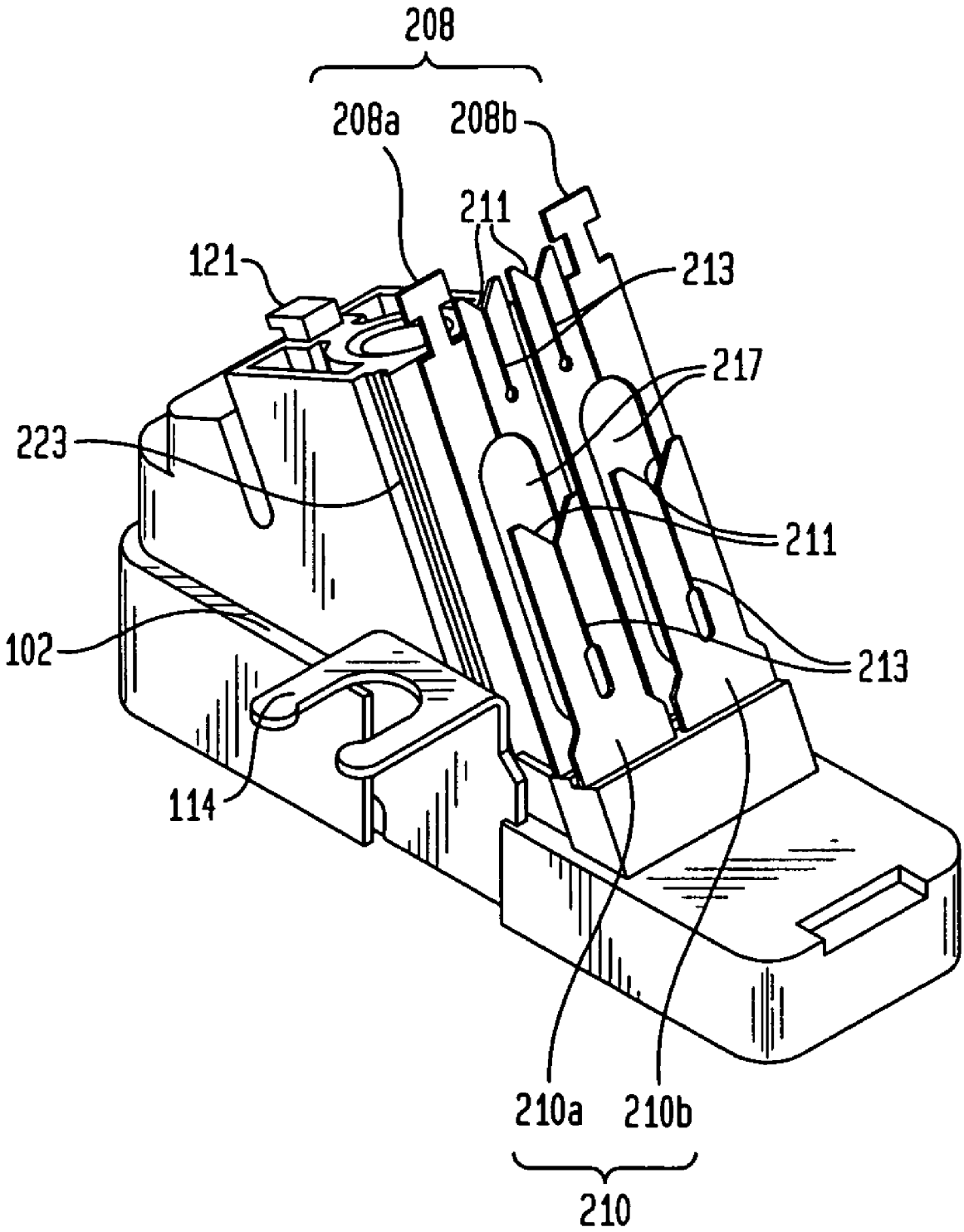
FIG. 2 is a perspective view the fusible link device of FIG. 1 with the cover removed.

These conductive terminals that are enclosed within housing 100 are shown in FIG. 2, which is a perspective view corresponding to FIG. 1 of fusible link device 100, but with cover 104 removed. Particularly, upper conductive terminals 208 and lower conductive terminals 210 are mounted into slots formed in base 104. Upper terminals 208 each have an elongated opening 217 aligned relative to the slits of lower terminals 210 such that wires inserted into lower ports 110 for contacting lower terminals 210 can pass through elongated openings 217, thus allowing the wires to be inserted further into these ports while also preventing the ends of the wires from abutting against the upper terminals (which abutting would possibly cause an unintended electrical connection that would shunt the fusible link that is provided between the lower and upper terminals). As shown, these terminals may be implemented as IDC connections, each terminal having a lengthwise slit 213 that defines a pair of sharp edges biased toward each other. A tapered, slightly concave entry edge 211 is located at the upper end of slit 213. When an insulated wire is placed on entry edge 211 and pushed downward into the slit 213, the sharp edges of slit 213 will cut the insulation and create electrical continuity between the wire and the terminal. These terminals, however, need not be implemented with IDC type connections; for example, they may be implemented as threaded post or screw-type connectors, lug connectors (e.g., spades), or other type of wire connectors (e.g., for soldering).

Figure 3:
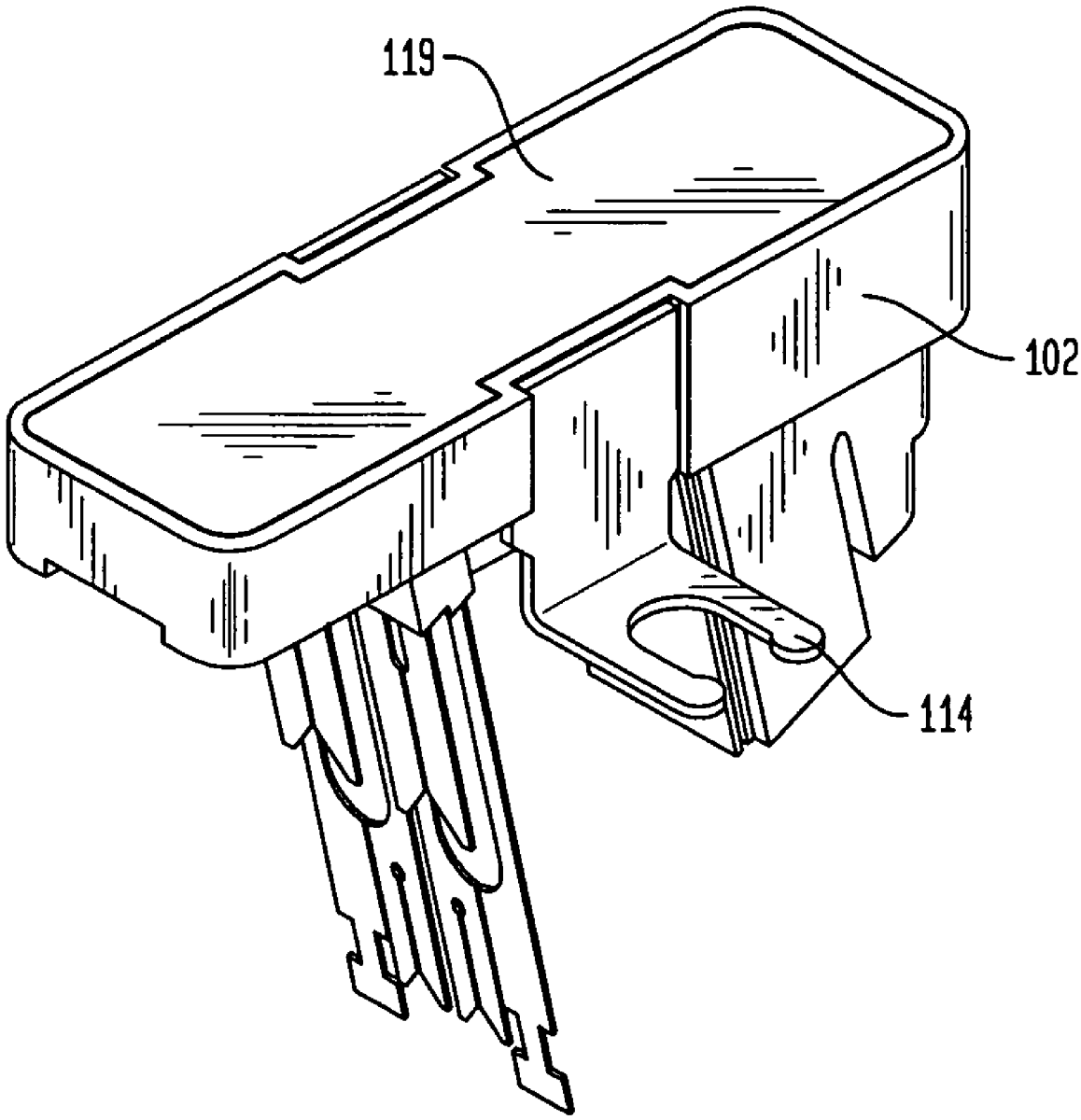
FIG. 3 illustrates a perspective view of the underside of the base of the fusible link device of FIG. 1 with a bottom cover of the base attached thereto.
Figure 4:
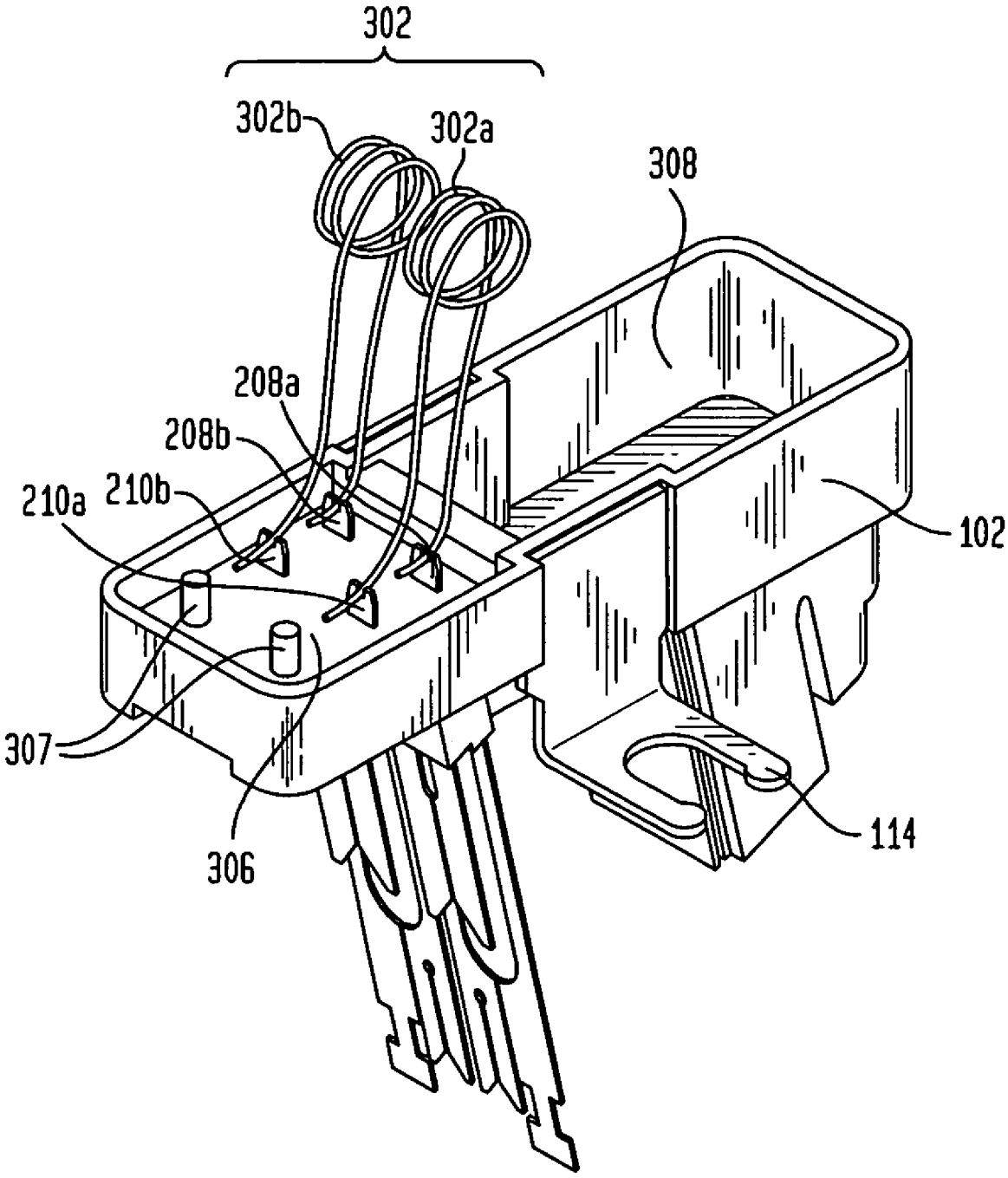
FIG. 4 is a perspective view of the underside of the base of the fusible link device of FIG. 1 without the bottom cover of the base attached.

FIG. 3 and FIG. 4 illustrate perspective views of the underside of base 102, with a bottom cover 119 of base 102 attached and removed, respectively. As shown in FIG. 4, the ends of terminals 108 and 110 that extend through slots in base 102 protrude into a hollow cavity or compartment 306 in the underside of the base unit, and are each formed as an IDC connection. By way of these IDC connections, fusible link 302 is conductively connected in series between one of the upper terminals 108 and one of the lower terminals 110. Similarly, fusible link 304 is series connected between the other upper and lower terminals. As mentioned for the other ends of the terminals 108 and 110, the ends of the terminals that are attached to the fusible links need not be IDC type connections, but may be implemented as other types of connectors that are suited for connecting the terminals and the fusible links. A potting compound (not shown) may applied in hollow compartment 306 to cover the terminal-to-fusible link connections to enhance the environment-proofing (e.g., waterproofing) of fusible link device 100.

Fusible links 302 and 304 are insulated wires of a gauge finer than that of any of the wires inserted into the ports 108 and 110, and the fusible link gauge and insulation type are selected according to the current limit at which the fusible link is desired to blow, this current limit being lower than that of any of the wires to be inserted into ports 108 and 110. The length of the fusible links 302 and 304 is selected to provide for sufficient separation between the ends of a blown fusible link to prevent possible arcing therebetween. As shown, the fusible links may be wound into loops and, in this embodiment, the loops are preferably disposed away from the region where the terminals are connected to the fusible links. More specifically, in this embodiment, the wound portions of fusible links 302 and 304 are disposed within a hollow cavity or compartment 308 of base 102, with cavity/compartment 308 being separated from compartment 306 by an intervening portion of base 102 that serves as a physical barrier or partition between these cavities/compartments and, particularly, between the terminal-to-fusible link connections and the lengths of the fusible links. This spatial separation prevents any deleterious effects that may be caused by the terminals being subject to the blowing of a fusible link, and, as further explained below, prevents the potting compound that may be applied in cavity/compartment 306 from encroaching onto the lengths of fusible links 302 and 304. It will be understood, however, that alternative implementations of a housing in accordance with the present invention need not provide separate compartments for, nor a barrier between, the terminal-to-fusible link connections and the lengths of the fusible links; for example, they may be located with the same hollow cavity or compartment without a barrier therebetween and without lateral or substantial separation therebetween.

Figure 5:
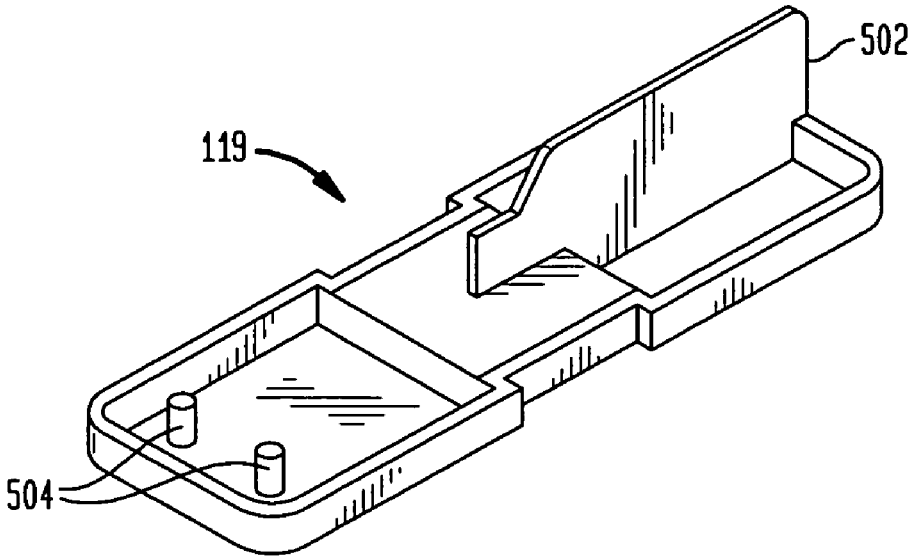
FIG. 5 is a perspective view depicting a bottom cover of the base of a fusible link device, in accordance with an embodiment of the present invention.

FIG. 5 depicts bottom cover 119 of base 102, in accordance with an embodiment of the present invention. Bottom cover 119 includes a partition 502 and pins 504, and may be formed from the same material as base 102. In attaching bottom cover 119 to the underside of base 102, pins 504 insert into and engage complementary sleeves 307 (shown in FIG. 3) provided within the underside of base 102. Additionally, at least a segment of one or more of the edges of partition 502 may engage or fit into one or more respective slots (not shown) provided at the walls of cavity/compartment 308. Partition 502 prevents any deleterious effects that may be caused by inadvertent damage to the insulation of the fusible links (i.e., exposed fusible link conductors) and/or by one or both fusible links blowing, such as a short circuit condition between the fusible links. In alternative implementations, such a partition need not be integrally formed with the bottom cover, but may be, for instance, integrally formed as part of the base 102, or may be a separate component. It is also understood, however, that alternative implementations of a housing in accordance with the present invention need not provide such a partition between the fusible links, which may be located within the same hollow cavity or compartment with no barrier therebetween.

The potting compound that may be applied in the region of cavity/compartment 306 may be applied at the time bottom cover 119 is attached such that the potting compound also bonds to the inner surface and/or the edges of bottom cover 119, thus further bonding and fixing bottom cover 119 as part of base 102. If a potting compound is used, however, it should preferably be prevented from encroaching onto or covering the segments of fusible links 302 and 304 that are intended to blow, as potting compound on the fusible links may affect (e.g., increase) their ampacity. Bottom cover 119 may alternatively, or additionally, be fixed by applying an epoxy, such as between pins 504 and sleeves 307. Environment proofing may also be enhanced by sealing the entire edge of cover 119 that adjoins bottom cover 102, such sealing being provided, for example, by applying an epoxy along this edge or by ultrasonically welding the edge of cover 119 to bottom cover 102.

Figure 6:
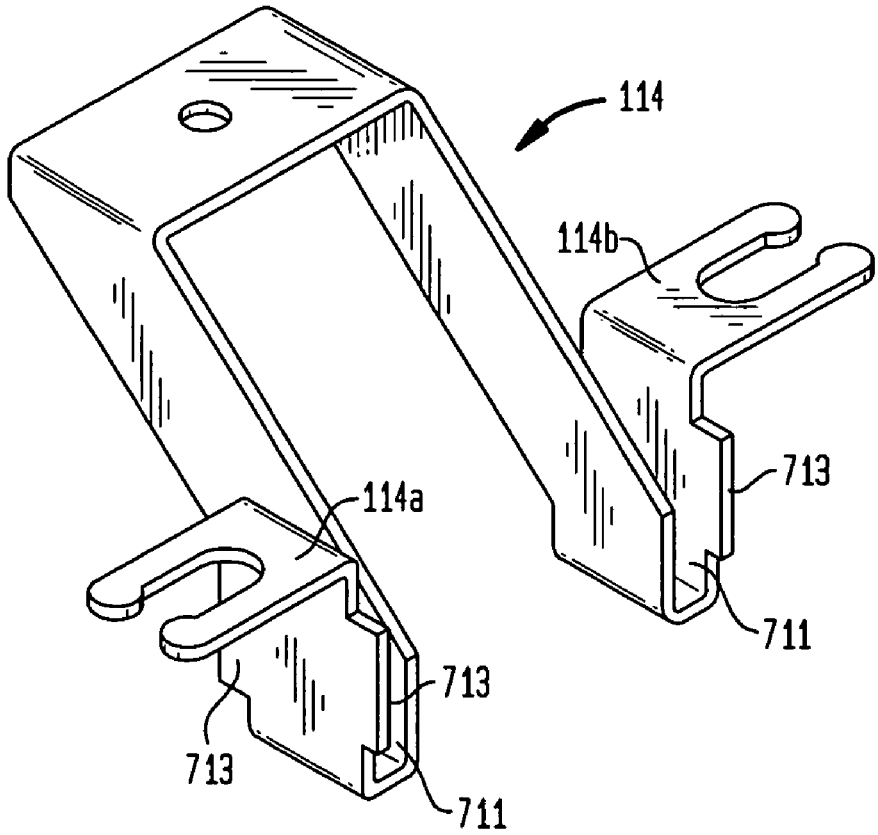
FIG. 6 is a perspective view illustrating a clip that is attached to the base of the fusible link device of FIG. 1, in accordance with an embodiment of the present invention.

In the foregoing FIGS. 1-4, a clip 114 is depicted; more specifically, in FIG. 1 this clip 114 is shown on one side of fusible link device 100, and in FIGS. 2-4, clip 114 is shown on the other side of fusible link device 100. FIG. 6 illustrates an embodiment of clip 114, showing that clip 114, which in this embodiment is made of a metal (e.g., copper, copper alloy, aluminum, aluminum alloy, etc.), includes two tab portions 114*a* and 114*b*. Clip 114 includes folded back portions 711 that engage the wall of the base 102, and tab portions 713 that fit into slots on the outside wall of base 102, for fixing clip 114 to base 102. Clip 114 may be used for mounting fusible link device 100, for example, within a terminal block closure or station protector closure, by inserting a screw or bolt through either one or both of tab portions 114*a* and 114*b*. In some applications, clip 114 may be additionally or alternatively used for establishing a connection electrical ground, and the connection of clip 114 to electrical ground may or may not also serve to mount the fusible link device. In accordance with an implementation of clip 114, each of these tab portions is made (e.g. by providing a crimp) to be snapped off, so that either one, both, or neither of these tab portions may be snapped off in the field, depending on the mounting arrangement and/or whether a ground connection is needed.

Figure 7:
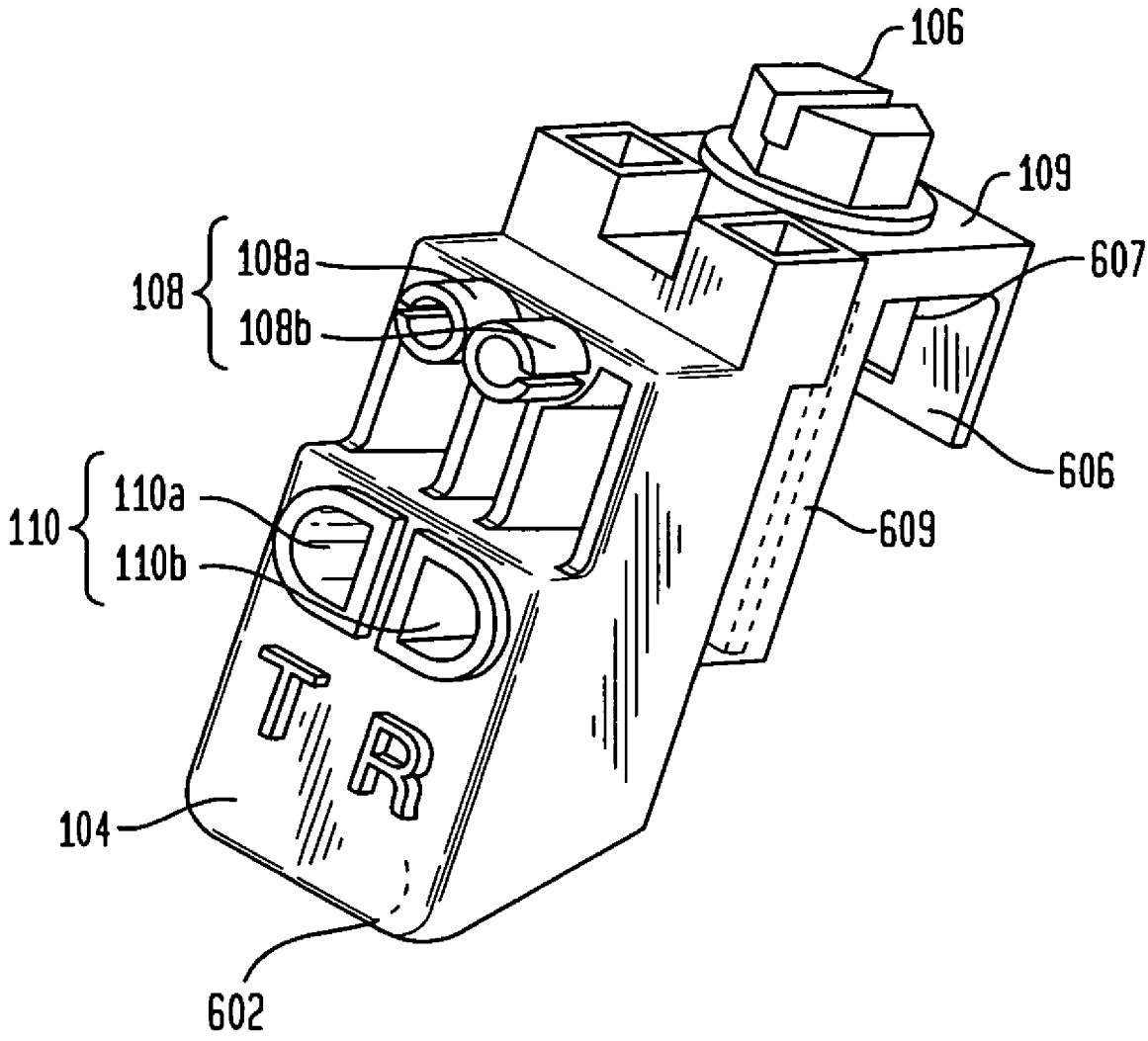
FIG. 7 is a perspective view depicting the cover, with drive screw attached, of the fusible link device of FIG. 1, in accordance with an embodiment of the present invention.

Referring now to FIG. 7, there is shown cover 104, detached from base 102, with drive screw 106 attached. Upper ports 108*a* and 108*b* are formed in alignment with upper terminals 208*a* and 208*b*, respectively, so that wires inserted into these ports will align with the IDC connectors. Similarly, lower ports 110*a* and 110*b* are formed in alignment with lower terminals 210*a* and 210*b*, respectively. Test ports 112*a* and 112*b* are formed so that they align with the T-shaped portions disposed at the top of terminals 108*a* and 108*b*, allowing for testing probes (e.g., "popper" type test clips) to be inserted therein to contact these terminals.

The underside of cover 104 has an opening 602, and the interior of cover 104 includes hollow regions, and polycarbonate structural features for implementing the ports to facilitate supporting the wires inserted therein such that the wires are forced down into the IDC terminals upon engaging drive screw 106. More specifically, upper ports 108 and lower ports 110 extend into the interior of cover 104, with upper ports 108 each bounded by a substantially cylindrical tubular polycarbonate surface, and with lower ports 110 each bounded by a substantially D-shaped polycarbonate surface. These polycarbonate port surfaces extend integrally to the interior sides and interior upper portion of cover 104, with slots being provided through these surfaces and surrounding regions to accommodate insertion of the terminals 208 and 210. The region between the edges of terminals 208*a* and 208*b* and the region between the edges of terminals 210*a* and 210*b* each include a partition that extends over a substantial length of this region (there being, therefore, four slots), with the lower extent of the partition ending at or near the portion of base 102 where the terminals are inserted therein. Each of the two slots provided for upper terminals 208*a* and 208*b* extend through both one of the lower D-shaped ports/surfaces and one of the upper cylindrical ports/surfaces. Each of the two slots provided for lower terminals 210*a* and 210*b* extends through one of the lower D-shaped ports/surfaces, but does not extend up through the upper cylindrical ports/surfaces. Cover 104 includes a lower cavity portion extending from opening 602 to the lower extents of these partitions and the lower extent of the slots. The hollow regions in cover 104 thus include this lower cavity portion, the slots, and the ports. At least a portion of the hollow interior compartment of cover 104, and/or each of ports 108, 110, and 112, and preferably all voids within cover 104, may be filled with a non-conductive gel to provide for additional environmental protection for the fusible link device 100 (e.g., preventing moisture from reaching the terminals within the cover, allowing sealed connections to be made to the terminals).

In accordance with an embodiment of the present invention, upper ports 110 are provided for inserting telco distribution wires and lower ports 108 are provided for inserting service drop lines, these ports being sized to accommodate the wire sizes that may be used. Typically, the telco distribution wires have wire gauges ranging from 22-26 AWG, and the service drop wires have wire gauges ranging from 18.5-24 AWG, with a heavy gauge wire in this range (e.g., 18.5-19 AWG) more typical for the service drop. Because the telco distribution wires are a light gauge, making them susceptible to falling out of ports 108 prior to being connected to the IDC terminals, ports 108 are preferably provided with strain relief slots 117 (shown in FIG. 1) into which the distribution wires may be inserted and retained to hold distribution wires in place within ports 108 until these wires are connected to the IDC terminals 208 by driving screw 106 to seat cover 104 onto base 102. In an alternative embodiment, the strain relief slots may be provided at a different location about the port (e.g., at the upper/top rather than at the sides).

Further referring to FIG. 7 and FIG. 1, cover 104 has a drive mechanism portion 109 disposed external to the compartment in which the terminals are enclosed. Drive mechanism portion 109 is provided with a through hole (not shown) adapted to receive the threaded portion of drive screw 106 therein. The head of screw 106 is provided with a slot suitable for engagement by a flat blade screw driver and is also shaped to be engaged by a standard (e.g., 216B) wrench. The screw 106 is preferably of the type that is self-retained in the cover 106, and this self-retainment mechanism provides for the cover 102 to be pulled up away from the base 104 when the drive screw is loosened. Drive mechanism portion 109 also includes an elongated tab 609 symmetrically disposed on each side (only one shown in FIGS. 1 and 6) of the rear portion of cover 104. An elongated integrally formed polycarbonate rail (shown as dashed/hidden line) extends along the length of the interior-facing side of each tab 609 and is adapted to slidably engage a complementary slot 223 (only a portion of which is shown in FIG. 1, and which is schematically depicted in FIG. 2) formed along the side of base 102, thus guiding the motion of cover 104 relative to base 104 as the drive screw 106 is driven in either direction. Drive mechanism region 109 is also provided at the rear portion thereof with an eye/guide member 606 that includes an aperture or eye 607 adapted to receive protruding portion 121 provided on the upper portion of base 102, which is shown in FIG. 2. When drive screw 106 is driven over its entire range, eye/guide member moves along a complementary slot provided in base 102, and eye 607 is appropriately sized so that protruding portion 121 of base 102 does not impede motion over this drive range.

The cover 104 and base 102 are assembled by sliding the cover 104 onto base 102 such that the terminals 108 and 110 slide into the corresponding slots within cover 104, the rails disposed at the sides of cover 104 slide into slots provided at the sides of base 102, and the screw 106 aligns to and sets in the complementary threaded hole at the top of base 102. The cover 104 and base 102 are retained in position by the eye member 607 receiving the protruding member that is disposed on the base 102, thereby preventing the cover and base from being separated from each other unless protruding portion and eye member are flexed away from each other. For cover 104 to be lowered from this position towards base 102, screw 106 must be threaded into the tapped/threaded bore in base 102.

Figure 8A:
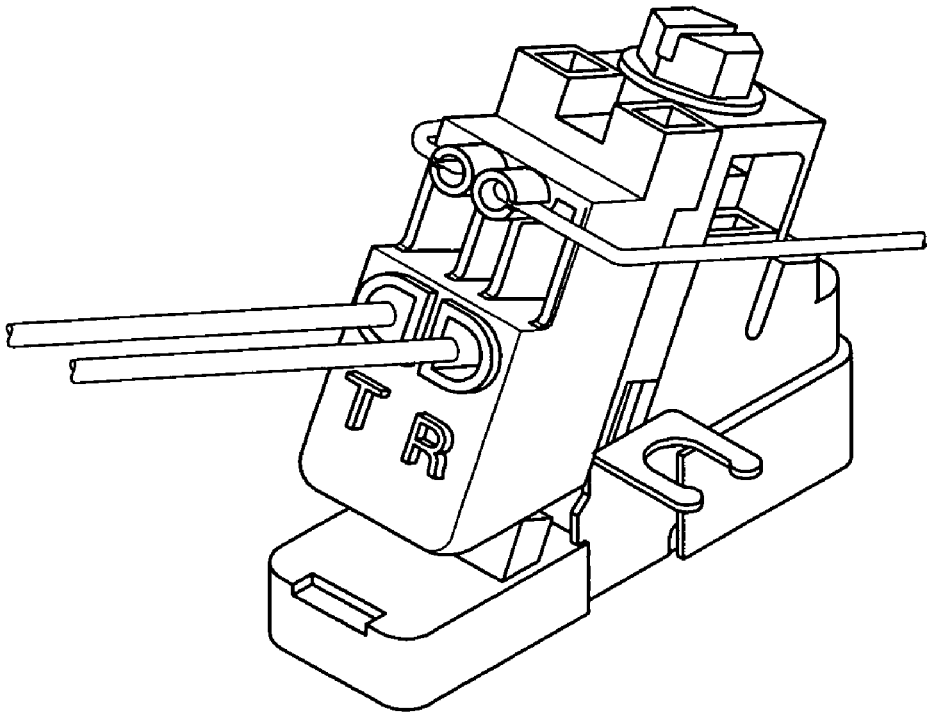
FIG. 8A is a perspective views of the fusible link device of FIG. 1 with wires inserted into the ports, and the cover in a raised position, in accordance with an embodiment of the present invention.
Figure 8B:
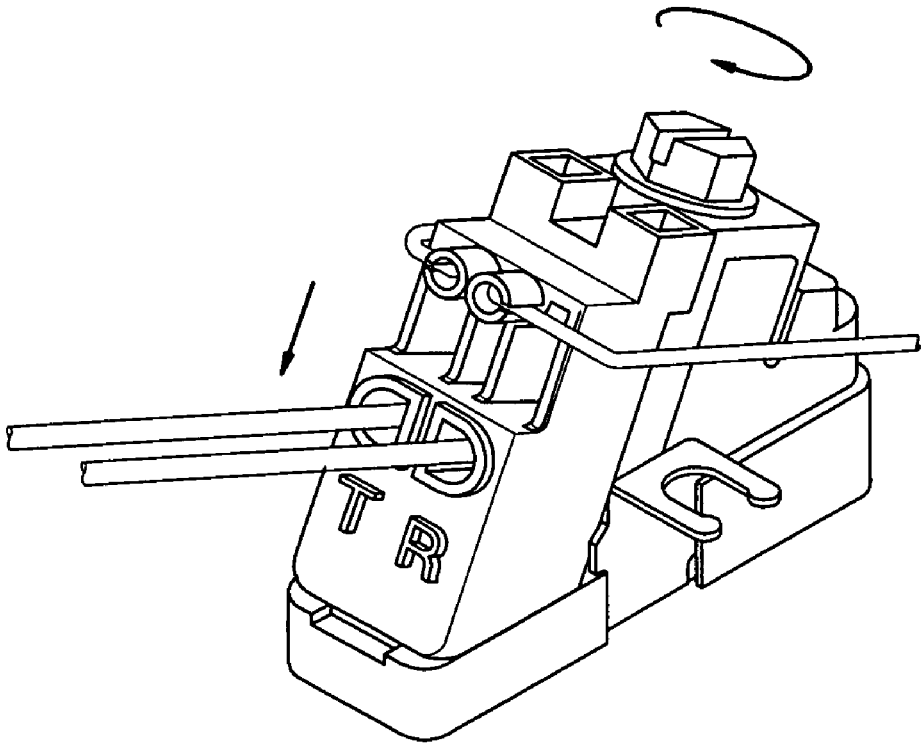
FIG. 8B is a perspective view of the fusible link device of FIG. 1 with wires inserted into the ports, and the cover in a lowered position, in accordance with an embodiment of the present invention.

In connecting wires to the fusing link device 100, the cover 104 is placed in its upper/open position (the lower portion of the cover spaced away from the base 102) by ensuring that drive screw 106 is driven to its full counter-clockwise position. Each pair of wires to be connected together (shorted) are then inserted into the appropriate ports 208 and 210, and the upper wires may be inserted into strain relief slots 117 to hold them in position, as shown in FIG. 8A. As illustrated by FIG. 8B, drive screw 106 is then rotated in a clockwise rotation, causing the cover 104 to move towards the base 102 and the wires to be driven into the IDC connectors, until the lower portion of cover 104 abuts against base 102, thus forming a fused electrical connection between each pair of upper and lower wires, and enclosing the terminals within the compartment formed by cover 104 and base 102, thereby providing reliable, fused, environmentally-protected connections.

In accordance with an embodiment of the present invention, it is understood that the housing of fusible link device 100 may optionally be provided with one or more additional protection devices. For instance, the fusible link device 100 may also include one or more voltage protection devices, of the same or different type, electrically connected across terminals that are not series connected to each other. More particularly, referring to the embodiment of the fusible link device described hereinabove, a voltage protection device (e.g., a gas tube protector) may be disposed within the base and connected in parallel across the tip and ring lines on one side of the fusible links (e.g., between terminals 208*a* and 208*b*, or between terminals 210*a* and 210*b*). Clip 114 may be connected to electrical ground to provide a ground path connection for the voltage protection device.

Figure 9:
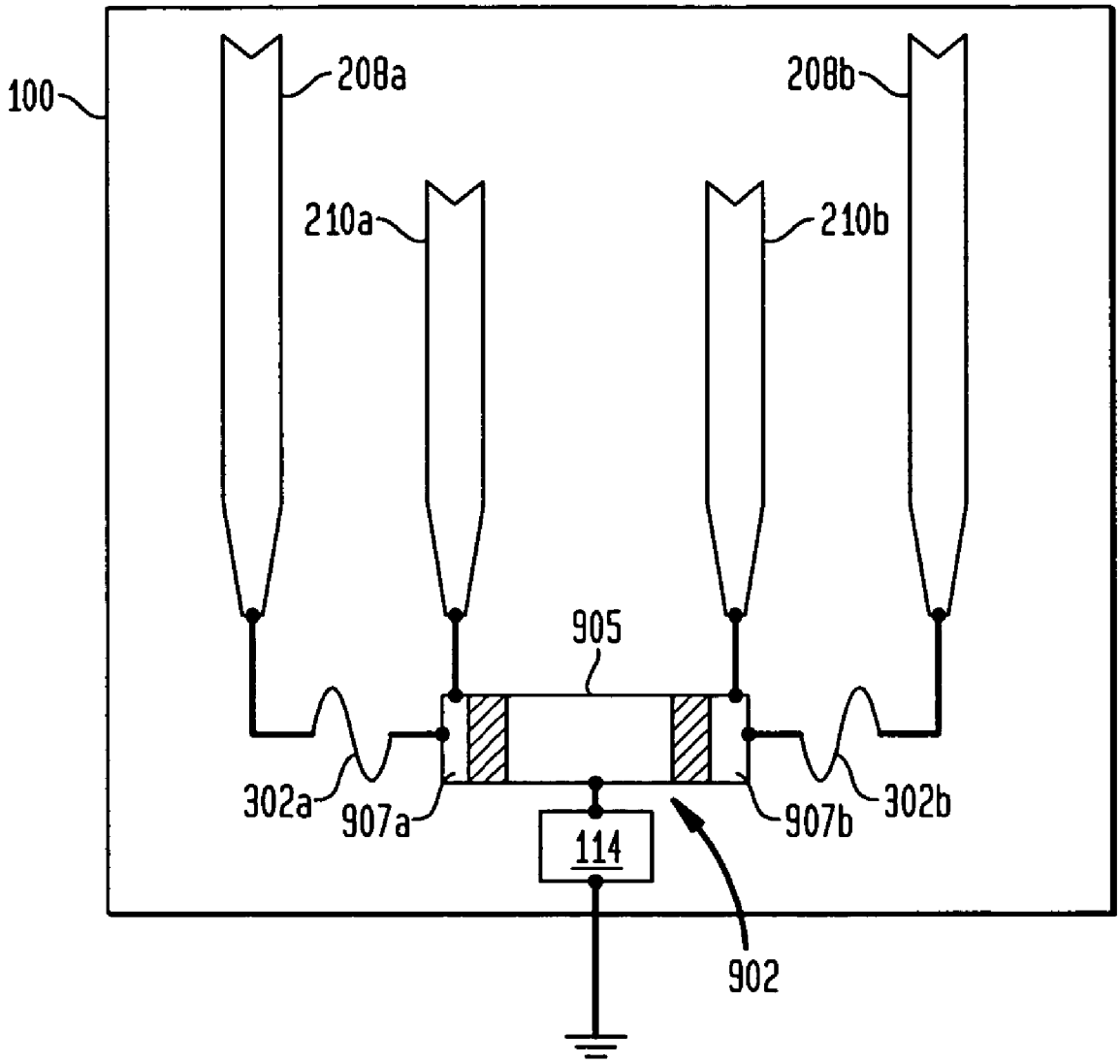
FIG. 9 schematically depicts a protector incorporated into a fusible link device, in accordance with a further embodiment of the present invention.

FIG. 9 schematically depicts a gas tube protector 902 incorporated into fusible link device 100, in accordance with an embodiment of the present invention. Protector 902 is a commercially available electrical device for protecting equipment against high or excessive voltage, such as caused by lightning strikes. Protector 902 has two contacts (not shown) spaced apart by an insulation gap, which is bridged if the voltage applied is high enough. Protector 902 has a ground leg 905 and tip and ring legs 907*a* and 907*b*. Ground leg 905 is electrically connected to clip 114, which is electrically connected to electrical ground. Tip leg 907*a* and ring leg 907*b* are electrically connected to terminals 210*a* and 210*b*, by a connector and/or soldering. Excessive voltage on either terminal 210*a* (as well as on 208*a* if fusible link 302*a* is not blown) or 210*b* (as well as on 208*b* if fusible link 302*b* is not blown) will discharge through protector 902 to ground. Those skilled in the art will understand that the housing and terminals may be implemented according to a variety of designs to incorporate and connect the voltage protection device with the terminals and fusible links within a common housing. For instance, the base unit may modified to include a separate cavity for mounting the protector 902. In accordance with a further embodiment of the present invention, yet an additional voltage protection device, of the same or different type as protector 902, may be connected in parallel across the tip and ring lines on the other side of the fusible links. By providing a voltage protector across the tip and ring lines on each side of the fusible links, if one or both fusible links blows, the lines on both sides of the fusible links are still protected from an overvoltage condition. It will be understood that additional voltage/surge protection devices may be included on either or both sides of the fusible links.

As mentioned above, and as will be understood by those skilled in the art, the embodiments and alternative implementations and variations described hereinabove are merely illustrative of the present invention, which is not limited thereto. For purposes of illustration, the following are some additional non-limiting examples of variations according to the present invention. It may be appreciated, for example, that the housing of a fusible link device may be of any shape or configuration suitable for use in the invention. More specifically, some of the housing design elements that may be varied include the number of components comprising the housing, the orientation and location of the ports, the sealing mechanism, and the allocation and number of compartments for the fusing elements and the terminals, provided the housing provides for a self-contained module that encloses or encases the terminals for terminating incoming and outgoing wiring along with the fusing links. As may be understood, additional and/or alternative ways of providing environmental protection or sealing include the use of compression-type fittings, possibly using an O-ring or gasket, with or without a non-conductive gel or grease material. Further, a fusible link device according to the present invention is not limited to only having four terminals for connecting one tip-ring line pair; for example, one or more additional pairs of terminals (each pair for connecting one incoming wire to one outgoing wire) may be enclosed in the fusible link, though for telco applications where the fusible link device is used for making tip-ring connections, the number of terminal pairs will typically be a multiple of two (two pairs of terminals, i.e., four terminals, for connecting each tip-ring pair). Additionally, although shown for use with wire pairs, the principles could be applied also to coaxial cable distribution blocks. Further, as may be appreciated from the foregoing, a fusible link device according to the present invention may be used in a variety of network termination applications, and in a telecommunications network such a fusible link device may be used at various locations such as at or within the premises or home environment, at the central office, or at various terminal blocks of the OSP, including for example, in network interface devices, building entrance terminals, optical network interface units, aerial terminals or other network deployment apparatuses.

Accordingly, although the above description of illustrative embodiments of the present invention, as well as various illustrative modifications and features thereof, provides many specificities, these enabling details should not be construed as limiting the scope of the invention, and it will be readily understood by those persons skilled in the art that the present invention is susceptible to many modifications, adaptations, variations, and equivalent implementations without departing from this scope and without diminishing its attendant advantages. It is further noted that the terms and expressions have been used as terms of description and not terms of limitation. There is no intention to use the terms or expressions to exclude any equivalents of features shown and described or portions thereof. It is therefore intended that the present invention is not limited to the disclosed embodiments but should be defined in accordance with the claims that follow.

What is claimed is:

1. A fusible link device, comprising:

a housing;

a plurality of terminals disposed within said housing, said terminals provided for connecting to wires inserted into said housing from the exterior of the housing;

a plurality of fusible links disposed within said housing, each fusible link conductively coupled in series between a respective two of said plurality of terminals, wherein the housing comprises:

a base closure having an upper surface, a sidewall surface, and a first hollow interior portion accessible from a first opening beneath said upper surface, said base closure including an attachable lower cover for covering the first opening, wherein said terminals are mounted through the upper surface of said base closure such that upper end portions of the terminals for connecting to wires inserted into said housing from the exterior of the housing are disposed above said upper surface, and opposite end portions of the terminals are disposed within the first hollow interior portion of the base closure; and an upper cover having a second hollow interior portion accessible through a second opening, and having for each terminal a respective environmentally protected port for inserting a wire to be connected to the terminal, said upper cover being engageable to the base such that the upper end portions of the terminals are disposed within the second hollow interior portion of the upper cover.

2. The fusible link device according to claim 1, wherein said housing provides an environmentally protected closure for said terminals and said fusible links.

3. The fusible link device according to claim 1, wherein for each terminal, said housing includes a respective environmentally protected port for inserting a wire to be connected to the terminal.

4. The fusible link device according to claim 3, wherein the environmentally protected ports are gel-sealed.

5. The fusible link device according to claim 3, said housing further comprising, for each pair of terminals coupled by a fusible link, an environmentally protected test port configured to provide for electrically contacting at least one of the terminals of the pair of terminals.

6. The fusible link device according to claim 1, wherein each of said terminals includes an insulation displacement connection for connecting wires inserted into said housing from the exterior of the housing.

7. The fusible link device according to claim 1, wherein the fusible links are provided as a length of insulated wire.

8. The fusible link device according to claim 7, wherein each of said terminals includes an insulation displacement connection for connecting said fusible link.

9. The fusible link device according to claim 7, wherein each of said fusible links has a wire gauge finer than the wire gauge of each of the wires to be connected to the terminals that are conductively coupled by the fusible link.

10. The fusible link device according to claim 1, further comprising at least one voltage protection device, each voltage protection device electrically connected across two of said terminals that are not series connected to each other.

11. The fusible link device according to claim 1, wherein the fusible links are spatially separated from each other by at least one partition.

12. The fusible link device according to claim 1, wherein the fusible links are spatially separated from portions of said terminals that are for attaching to wires inserted into said housing from the exterior of the housing.

13. The fusible link device according to claim 12, wherein the fusible links are disposed in a compartment of said housing that is partitioned from another compartment containing at least the portions of said terminals that are for attaching to wires inserted into said housing from the exterior of the housing.

14. The fusible link device according to claim 1, wherein each fusible link is provided as a length of insulated wire having ends electrically connected to the terminals that are conductively coupled by the fusible link, wherein the length of insulated wire forming the fusible link is spatially separated from the ends that are electrically connected to the terminals.

15. The fusible link device according to claim 14, wherein for each fusible link, the length of insulated wire forming the fusible link is disposed in a compartment of the housing that is spatially separate from a second compartment of the housing in which are disposed the ends that are electrically connected to the terminals.

16. The fusible link device according to claim 15, further comprising a potting compound covering the ends that are electrically connected to the terminals, and covering at least the portions of the terminals that connect to the ends, said potting compound not covering the length of insulated wire that forms the fusible link and is disposed in the compartment of the housing that is spatially separate from the second compartment.

17. The fusible link device according to claim 1, said upper cover further comprising, for each pair of terminals coupled by a fusible link, an environmentally protected test port configured to provide for electrically contacting at least one of the terminals of the pair of terminals.

18. The fusible link device according to claim 17, wherein the fusible links are spatially separated from each other by at least one partition.

19. The fusible link device according to claim 18, wherein the at least one partition is integrally formed as a portion of the attachable lower cover.

20. The fusible link device according to claim 1, wherein the fusible link device includes a total of four of the terminals and two fusible links for terminating and fusing the tip and ring lines in a telecommunications network.

* * * * *